US005931536A

United States Patent [19]

Wu

[11] Patent Number: 5,931,536

[45] Date of Patent: Aug. 3, 1999

[54] ADJUSTABLE ARMREST OF A CHAIR

[76] Inventor: Yao-Chuan Wu, No.1—1, Nei-Pu Tsai, Da-Chi Village, Min-Hsiung Hsiang, Chai-I Hsien, Taiwan

[21] Appl. No.: 08/951,475

[22] Filed: Oct. 16, 1997

[51] Int. Cl.[6] ..... A47C 7/54

[52] U.S. Cl. ..... 297/411.35; 297/411.36; 297/344.19; 248/404; 248/118

[58] Field of Search ..... 297/411.35, 411.36, 297/411.37, 411.38, 411.3, 411.31, 411.2, 344.19, 344.18, 344.2; 248/404, 118, 631

[56] References Cited

U.S. PATENT DOCUMENTS

| | | | |
|---|---|---|---|
| 3,788,587 | 1/1974 | Stemmler | 248/404 X |
| 5,031,869 | 7/1991 | Strater et al. | 297/344.18 X |
| 5,078,351 | 1/1992 | Gualtieri | 248/404 X |
| 5,382,079 | 1/1995 | Wilson et al. | 297/411.35 X |
| 5,407,249 | 4/1995 | Bonutti | 297/411.36 X |
| 5,636,899 | 6/1997 | Schiff et al. | 297/344.19 X |

FOREIGN PATENT DOCUMENTS

| | | | |
|---|---|---|---|
| 133523 | 2/1985 | European Pat. Off. | 297/344.19 |

*Primary Examiner*—Laurie K. Cranmer
*Attorney, Agent, or Firm*—Peterson, Wicks, Nemer & Kamrath, PA

[57] ABSTRACT

An improved adjustable armrest for use on a chair is particularly related to an adjustable armrest in connection to a pneumatically operated cylinder permitting the armrest body to be vertically lifted up by actuation of a control stick or lowered down by a manual force against the armrest body. An armrest mount having tracks defined thereon for mounting of the armrest body permits the armrest to be slidably adjusted back and forth. The armrest mount with the armrest body is secured to a housing having a vertical hole for receiving the cylinder having one end engaged with the underside of a bottom bracket which is secured to the armrest mount. The cylinder housed in a tubular sleeve is fixed at the bottom end thereof to a support bracket and is engaged with a hand operated stick at the top end so that the actuation of the control stick results in the extension of the cylinder and the armrest body accordingly. The tubular sleeve having a protrusion block and a retaining member is rotatably housed in the vertical hole with the protrusion block located in a wavy recess having a plurality of retaining cavities so as to permit the housing along with the armrest body be adjustably rotate within a certain angular range with respect to the tubular sleeve.

3 Claims, 4 Drawing Sheets

ADJUSTABLE ARMREST OF A CHAIR

BACKGROUND OF THE INVENTION

The present invention relates to an improved adjustable armrest for use on a chair and more particularly to an adjustable armrest engaged with a pneumatically operated cylinder so as to permit the armrest body to be vertically lifted up by actuation of a control stick or lowered down by a manual force exerted against the armrest body. An armrest mount having tracks defined thereon for mounting of the armrest body permits the armrest body to be slidably adjusted back and forth thereon. The armrest mount with the armrest body is mounted to a housing having a vertical hole for receiving the cylinder engaged with the underside of the armrest mount at the top end thereof and received in a tubular sleeve at the bottom. The tubular sleeve having a protrusion block and a retaining means for housing the cylinder is rotatably housed in the vertical hole with the protrusion block located in a wavy recess having a plurality of retaining cavities of the vertical hole so as to permit the housing along with the armrest body to be adjustably pivoted within a certain angular range with respect to the tubular sleeve.

Chairs have been designed and produced in many types to meet various needs of people and suit for occasions and places of different kinds. It is a primary concern in producing a chair to make a person feel comfortable and relaxed when sitting on a chair. There are many kinds of chairs available on the markets, such as swivel chairs, rocking chairs, office chairs, folding chairs and etc. The armrests designed for a chair are a critical portion in designing and producing a comfortable chair in addition to the backrest and seating portion of a chair. Armrests are very important because people feel comfortable and relaxed when sitting on a chair for a long time with their arms fitly resting on the armrests. In general, the armrests of a chair are fixed to the chair without adjustability, making people of different physical sizes uncomfortable in case their arms do not relaxedly rest on the armrests.

However, a prior art adjustable armrest using a locking pin to fit in differently positioned retaining holes so as to permit the armrests of a chair to be adjustable still has the following disadvantages:

1. the adjustment must be made in stagewise manner and can not be performed in a stageless way and the locking pin must be removed and engaged with the retaining holes in every adjustment.

2. the assembly of the prior art adjustable armrests is relatively complex and time consuming, resulting in the cost of production too high to compete on markets.

SUMMARY OF THE INVENTION

Therefore, the primary object of the present invention is to provide an improved adjustable armrest for use on a chair, which is mounted onto a housing rotatably engaged with a tubular sleeve. A pneumatically operated cylinder received in the tubular sleeve has its bottom end fixed to a support bracket secured to the bottom of a chair. A control stick is engaged with the cylinder so that the actuation of the control stick can make the cylinder extend, resulting in the vertical up-lift of the armrest body; and a manual press against the armrest body can push down the armrest body in adjustment.

Another object of the present invention is to provide an improved adjustable armrest which is easy and quick to be produced and installed so as to effectively reduce the cost of manufacture, making it more competitive in markets.

One further object of the present invention is to provide an improved adjustable armrest having a housing which is provided with a vertical hole having a wavy recess with a plurality of retaining cavities defined thereon. The tubular sleeve having a protruding block and a retaining means is placed in the vertical hole of the housing with the protruding block and the retaining means adjustably engaged with the retaining cavities of the wavy recess whereby the armrest body mounted onto the housing can be rotatably adjusted within a certain angular range, making the armrests adjustable to best suit for the arms of a person sitting in different poses.

BRIEF DESCRIPTION OF THE DRAWINGS

FIG. 4A is a diagram showing the armrest body being adjustable on the armrest mount.

DETAILED DESCRIPTION OF THE PREFERRED EMBODIMENT

Figure 1:
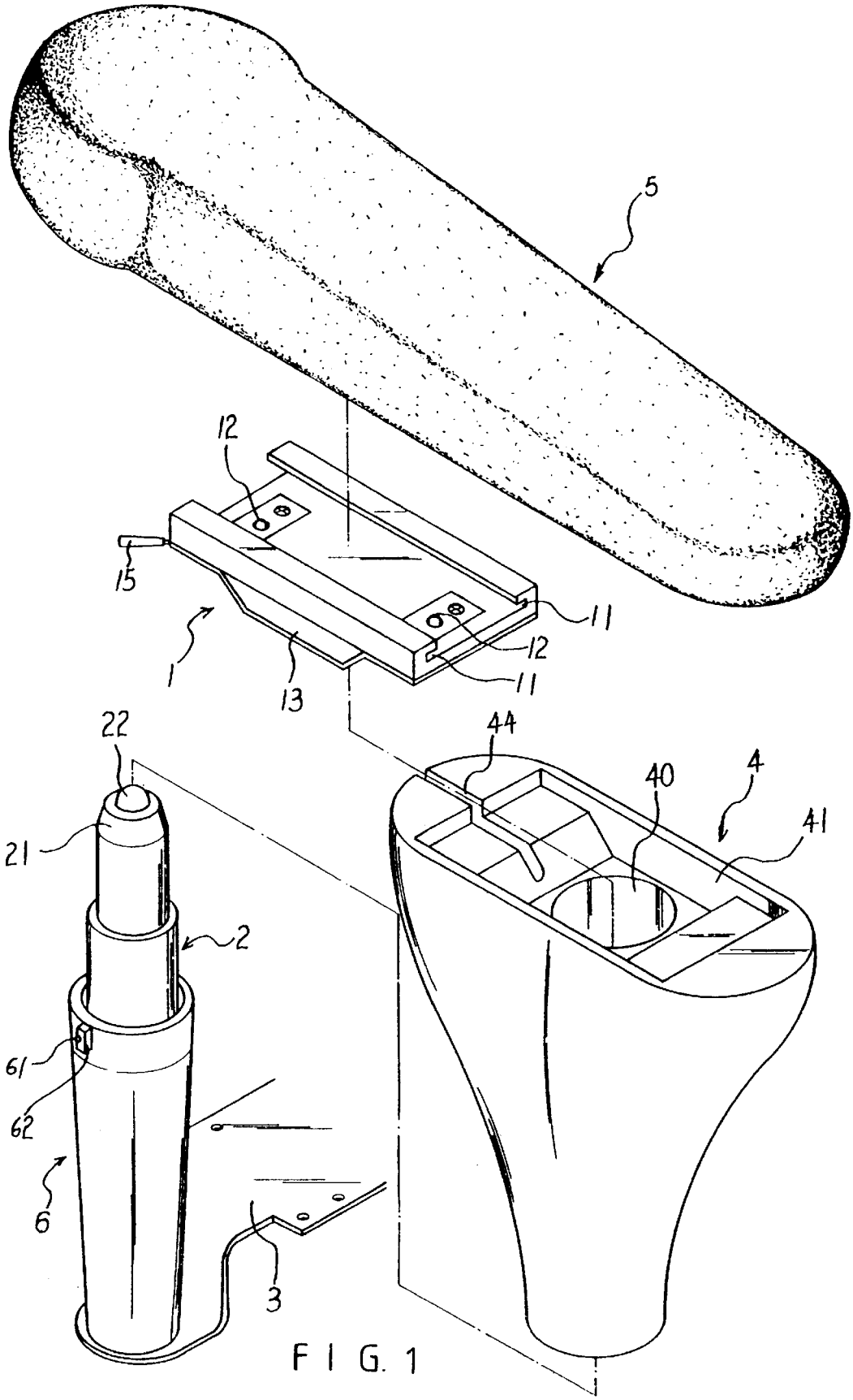
FIG. 1 is a perspective diagram showing the exploded components of the present invention.
Figure 2:
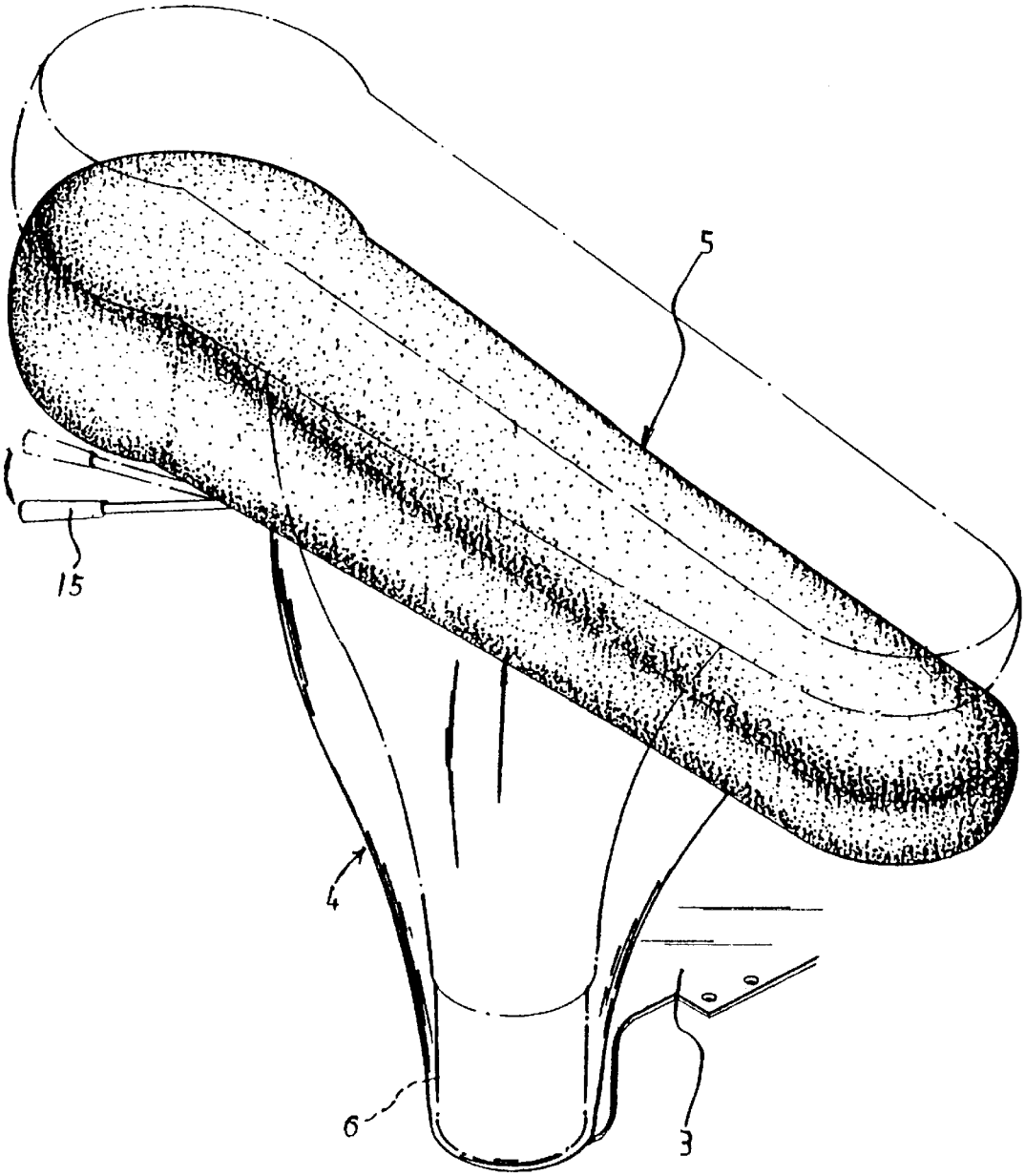
FIG. 2 is a diagram showing the vertical adjustment of the armrest body of the present invention.
Figure 4:
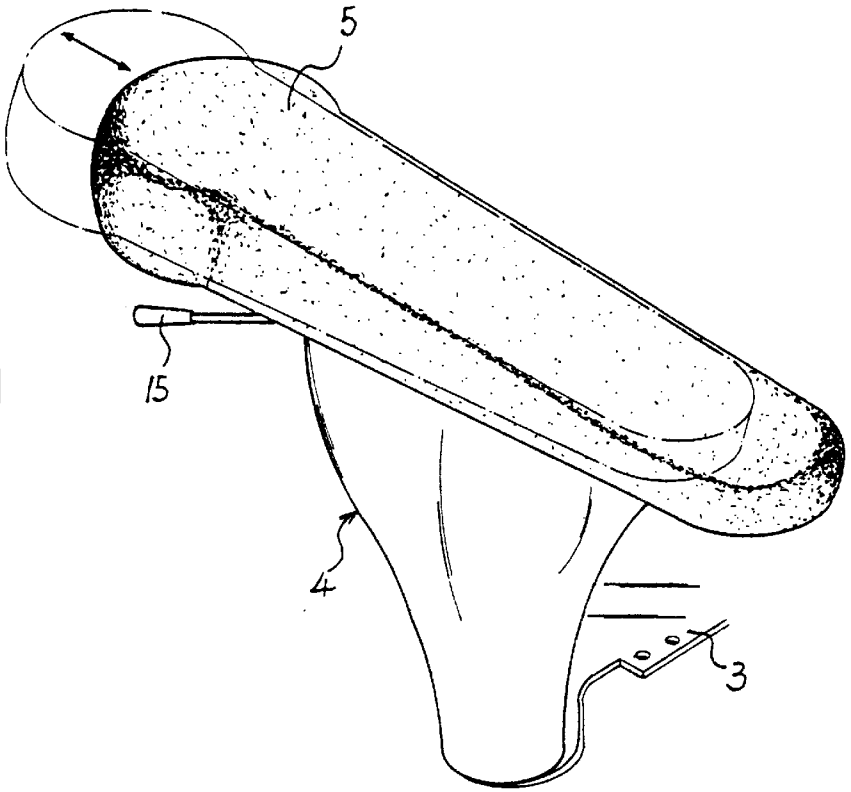
FIG. 4 is a diagram showing the linear adjustment of the armrest body on the armrest mount of the present invention.
Figure 3:
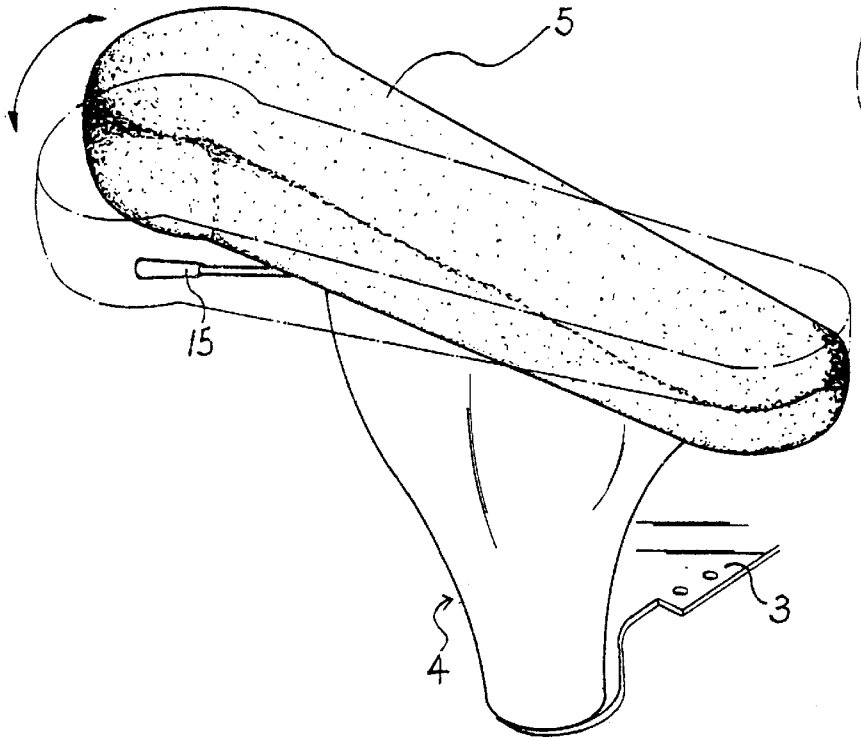

Referring to FIGS. 1, 2, 3, the improved armrest of the present invention is mainly comprised of an armrest mount 1, a pneumatically operated cylinder 2, a support bracket 3, a housing 4, an armrest body 5 and a tubular sleeve 6.

Figure 1A:
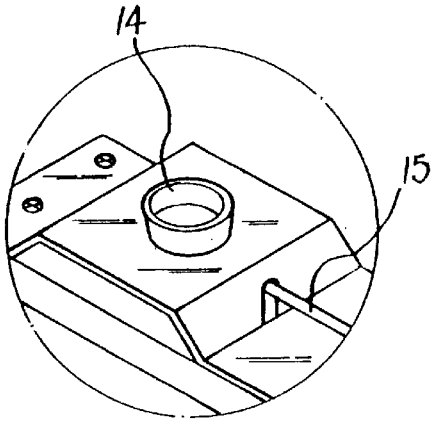
FIG. 1A is an enlarged diagram showing the reverse side of the bottom bracket.
Figure 3A:
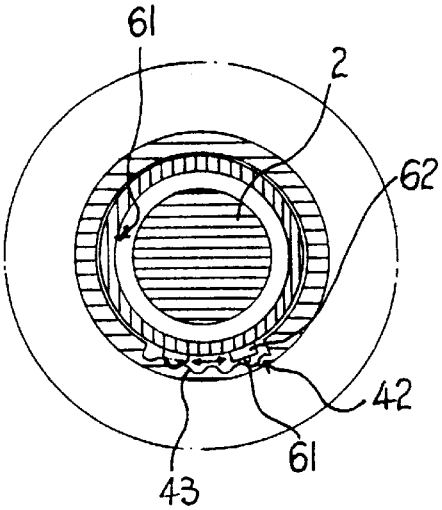
FIG. 3A is sectional diagram showing the tubular sleeve rotationally located in the housing.
Figure 3B:
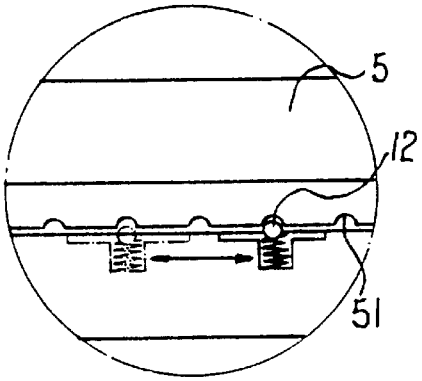
FIG. 3 is a diagram showing the rotational adjustment of the armrest body of the present invention.

The armrest mount 1 equipped with tracks 11 for the sliding installation of the armrest body 5 is provided with spring biased retaining balls 12 disposed on the top surface of the armrest mount 1 and located between the two tracks 11. There are a plurality of receiving recesses 51 defined on the underside of the armrest body 5 in correspondence to the spring biased retaining balls 12 so that the armrest body 5 can be slidably adjusted on and secured to the armrest mount 1. A bottom bracket 13 secured to the underside of the armrest mount 1 is provided with a conically shaped flange 14 for receiving the corresponding head of the cylinder 2 and a hand operated control stick 15, as shown in FIG. 1A.

The bottom of the pneumatically operated cylinder 2 having a conic head 21 is mounted onto and secured to the downwardly bended portion of the support bracket 3. An abutment rod 22 housed in the cylinder 2 is in abutment against the control stick 15.

The housing 4 has a vertical hole 40 for housing the tubular sleeve 6 which is led into the hole 40 from the bottom of the housing 4 and a cavity 41 disposed at the top of the housing 4 for installation of the armrest mount 1 as well as the support bracket 13. A longitudinal ditch 44 is defined at the top of the housing 4 for receiving the control stick 15. On the inner wall of the vertical hole 40 is provided with a wavy recess 42 having a plurality of retaining cavities 43.

The tubular sleeve 6 having the cylinder 2 housed therein is provided with a protruding block 62 having a retaining means 61 on the external surface thereof The bottom end of the cylinder 2 is fixed to the support bracket 3 secured to the underside of a chair.

In assembly, the support bracket 3 is first secured to the bottom of a chair and the tubular sleeve 6 with the cylinder 2 is vertically positioned on the bended support bracket 3, and then the housing 4 is mounted onto the tubular sleeve 6 and the support bracket 3 with the retaining means 61 of the tubular sleeve 6 selectively engaged with the retaining cavities 43. The armrest mount 1 housed in the cavity 41 of the housing 4 is engaged with the conic head 21 of the cylinder 2 by way of the conically shaped flange 14; and the armrest body 5 is slidably mounted onto the armrest mount 1 to complete the assembly.

In practical operation, the control stick 15 in direct abutment against the abutment rod 22 of the pneumatically operated cylinder 2 is able to be actuated to cause the cylinder 2 to lift up, so do the armrest mount 1 along with the housing 4 and the armrest body 5 in adjustment. To lower down the armrest body 5, a person has only to operate on the control stick 15 and then force the armrest body 5 downwardly, causing the cylinder 2 to resume its normal non-operation length whereby the armrest of a chair can be adjusted in a stageless manner, as shown in FIG. 2.

It can be clearly seen from the drawings that the armrest body 5 can be slidably moved forwardly or backwardly on the armrest mount 1 as shown in FIG. 2. in addition to the up and down adjustment of the armrest body 5 as illustrated in FIG. 2. Furthermore, the armrest body 5 can be adjusted pivotally to the left or right within a certain range of angles, as shown in FIG. 3, because the housing 4 engaged with the armrest mount 1 is rotatably engaged with the tubular sleeve 6 and the protrusion block 62 of the tubular sleeve 6 is slidably adjusted within the wavy recess 42 and the retaining means 61 of the protrusion block 62 can fall into limiting engagement with the one of the retaining cavities 43 for positioning. So, the armrest body 5 can be adjusted with ease in three ways as described above.

I claim:

1. An improved adjustable armrest for use on a chair, comprising:

an armrest mount, a pneumatically operated cylinder, a support bracket, a housing, and an armrest body;

said armrest body mounted onto said armrest mount;

a bottom bracket having a conically shaped flange disposed on the underside thereof being secured to the underside of said armrest mount with a corresponding conic head of said cylinder engaged with said flange and a hand operated control stick mounted onto said bottom bracket;

said pneumatically operated cylinder having said conic head being secured at its bottom end to said support bracket secured to the underside of a chair;

an abutment rod housed in said cylinder being in abutment with said hand operated control stick so that actuation of said hand operated control stick making said pneumatically operated cylinder to extend accordingly;

said housing having a vertical hole for housing said cylinder and a cavity disposed at the top of the housing for installation of said armrest mount as well as said support bracket;

a longitudinal ditch being defined at the top of the housing for receiving said hand operated control stick;

whereby actuation of said hand operated control stick will make said pneumatically operated cylinder extended, resulting in the lift up of said housing together with said armrest body accordingly so as to adjust the height of said armrest body, to lower down said armrest body, said hand operated control stick is actuated with said armrest body pushed with force downwardly to effect the vertical adjustment of said armrest body.

2. The improved adjustable armrest as claimed in claim 1 wherein said armrest mount is equipped with tracks for the sliding installation of said armrest body and is further provided with spring biased retaining balls defined on the top surface of said armrest mount and located between said two tracks; and a plurality of receiving recesses are defined on the underside of said armrest body in correspondence to said spring biased retaining balls so that said armrest body can be slidably adjusted back and forth and limited in position by way of said spring biased retaining balls on said armrest mount.

3. The improved adjustable armrest as claimed in claim 1, wherein said vertical hole has a wavy recess having a plurality of retaining cavities on the inner face thereof; and a tubular sleeve has retaining means defined on a protruding block on the external surface thereof in correspondence to said wavy recess and said retaining cavities on the inner wall of said vertical hole so as to permit said housing to be rotatably adjusted with respect to said tubular sleeve within a certain angular range with said retaining means selectively engaged with the retaining cavities.

* * * * *